US005542232A

United States Patent [19]

Beierlorzer

[11] Patent Number: 5,542,232

[45] Date of Patent: Aug. 6, 1996

[54] TRANSITIONAL SLIDE FOR USE WITH A CUSHION-CREATING MACHINE

[75] Inventor: Edwin P. Beierlorzer, Bellevue, Wash.

[73] Assignee: Ranpak Corp., Concord Township, Ohio

[21] Appl. No.: 155,115

[22] Filed: Nov. 19, 1993

[51] Int. Cl.[6] ..... B65B 63/04

[52] U.S. Cl. ..... 53/117; 53/390; 53/520; 83/165; 83/167

[58] Field of Search ..... 493/411, 967, 493/25 A, 4, 38; 83/158, 165, 167; 53/115, 117, 118, 520, 155, 238, 390, 522, 513, 153, 255

[56] References Cited

U.S. PATENT DOCUMENTS

| | | | |
|---|---|---|---|
| 585,988 | 10/1897 | Rabin et al. | 53/522 |
| 2,109,294 | 2/1934 | Kimball et al. | 53/153 |
| 3,377,771 | 4/1968 | Schmidt | 53/153 |
| 3,425,184 | 2/1969 | Heliot | 53/251 |
| 3,509,797 | 5/1970 | Johnson | 93/1 |
| 3,949,856 | 4/1976 | Ulber et al. | 197/133 R |
| 4,026,198 | 5/1977 | Ottaviano | 93/1 |
| 4,085,662 | 4/1978 | Ottaviano | 93/1 |
| 4,109,040 | 8/1978 | Ottaviano | 428/129 |
| 4,237,776 | 12/1980 | Ottaviano | 493/382 |
| 4,541,228 | 9/1985 | Peterson | 53/253 |
| 4,557,716 | 12/1985 | Ottaviano | 493/464 |
| 4,650,456 | 3/1987 | Armington | 493/464 |
| 4,717,613 | 1/1988 | Ottaviano | 428/129 |
| 4,750,896 | 6/1988 | Komaransky et al. | 493/357 |
| 4,968,291 | 11/1990 | Baldacci et al. | 493/354 |
| 5,123,889 | 6/1992 | Armington et al. | 493/352 |

FOREIGN PATENT DOCUMENTS 274188 12/1989 Germany .

*Primary Examiner*—John Sipos
*Assistant Examiner*—Gene L. Kim
*Attorney, Agent, or Firm*—Renner, Otto, Boisselle & Sklar, PLL

[57] ABSTRACT

A packaging system comprising a cushion-creating machine (10) and a slide (12) positioned adjacent to the machine (10). The cushion-creating machine (10) includes a frame (36) and cushion-creating assemblies (50, 52, 54, and 56) which are mounted to the frame (36) and which create cushioning products (32). The machine frame (36) includes an exit through which the cushioning products (32) are discharged in a predetermined discharge direction D. The slide (12) includes a smooth sloped surface (60) with a top portion positioned proximate to the machine's exit so that the discharged cushioning products (32) will be deposited thereon. The smooth sloped surface (60) has a pitch angle which is sufficient to insure that cushioning products placed on the top portion of the surface will slide in a predetermined slide direction S. The smooth sloped surface (60) is oriented relative to the machine (10) in such a manner that the slide direction S is substantially perpendicular to the discharge direction D.

9 Claims, 2 Drawing Sheets

TRANSITIONAL SLIDE FOR USE WITH A CUSHION-CREATING MACHINE

FIELD OF THE INVENTION

This invention relates to a transitional slide for use with a cushion-creating machine.

BACKGROUND AND SUMMARY OF THE INVENTION

In the process of shipping an item from one location to another, a protective packaging material is typically placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials have made paper protective packaging material a very popular alterative. Paper is biodegradable, recyclable and renewable; making it an environmentally responsible choice for conscientious companies.

While paper in sheet form could possibly be used as a protective packaging material, it is usually preferable to use paper cushioning products. Such products may be produced by cushion-creating machines, such as the cushioning conversion machines disclosed in U.S. Pat. Nos. 4,026,198; 4,085,662; 4,109,040; 4,237,776; 4,557,716; 4,650,456; 4,717,613; 4,750,896; and 4,968,291. (These patents are all assigned to the assignee of the present invention and their entire disclosures are hereby incorporated by reference.) Such cushioning conversion machines convert sheet-like stock material, such as paper in multi-ply form, into low density cushioning products, or pads. The pads produced by these machines each have lateral pillow-like portions separated by a thin central band. These pads may be of a variety of lengths and they are usually substantially longer than they are wide.

In the above-discussed cushioning conversion machines (and, in fact, in most cushion-creating machines), the cushioning products are discharged in a predetermined discharge direction through an exit in the machine's frame. Typically, the cushioning products are discharged to a transitional zone and then, at the appropriate time, inserted into a container for cushioning purposes.

In the past, a variety of arrangements have been used as transitional zones in packaging systems. For example, temporary receptacles (i.e., bins) have been placed adjacent the machine's exit so that the cushioning products can be discharged therein to form a pile. At the appropriate time, the packaging person would reach into the transitional receptacle, retrieve a cushioning product from the accumulated pile, return to his/her workstation and then insert the cushioning product in the container.

Additionally, horizontal packaging surfaces (i.e., tables) have been employed as transitional zones. Specifically, the horizontal surface is positioned so that the cushioning products are deposited thereon. When a packaging need arises, the packaging person picks up the cushioning product from the transitional surface and then, if the transitional surface also functions as a workstation, immediately inserts the cushioning product in the container.

Applicant is also aware that a "slide" has been used as a transitional zone for a cushion-creating machine. Specifically, this slide consisted of a semi-cylindrical conduit having a width just slightly greater than the width of the cushioning products. The slide was positioned adjacent to the machine so that its top portion was proximate to the machine's exit whereby the discharged cushioning products would be deposited thereon. Additionally, the slide was oriented relative to the machine so that it was longitudinally aligned with the product direction discharge. (In other words, the slide direction was a continuation of the machine's discharge direction.) In this manner, the discharged cushioning products stacked end-to-end in the conduit and, at the appropriate time, the bottom pad would be removed and used for cushioning purposes.

These and other transitional zones have all performed quite successfully in a variety of packaging systems and applicant expects they will continue to do so in the future. However, a certain packaging situation has recently arisen which has some special transitional needs. Particularly, this packaging situation requires a transitional zone which can accommodate pads of substantial lengths (i.e., up to four feet), which presents the pads in an orderly sequential fashion, which occupies a minimal amount of space, and which maximizes packaging efficiency.

None of the above-discussed transitional zones appears to be capable of satisfying all four of these transitional requirements. Specifically, a temporary receptacle (i.e., a bin) will not present the pads in an orderly fashion because they are simply accumulated in a pile. Moreover, most "space-conserving" forms of receptacles require a packaging person to bend over to retrieve a cushioning product. While a transitional horizontal surface (i.e., a table) may be designed to eliminate the need for a packaging person to bend over, the pads will still be accumulated in a pile and may even fall off the surface in a high volume situation.

Regarding the transitional "slide" described above, it would appear to present the pads in an orderly, sequential fashion. However, it would have to be at least eight feet long to accommodate two four feet pads, and at least sixteen feet long to accommodate four of such pads. Consequently, such a slide would occupy a significant amount of space at the packaging site, especially if the outlet of the slide was positioned at a convenient height (i.e., waist level). Moreover, the cushion-creating machine would have to be substantially elevated so that its exit was positioned adjacent the top portion of the slide.

Accordingly, applicant developed a transitional zone which satisfies all four of these transitional requirements. Particularly, applicant's invention provides a packaging system comprising a cushion-creating machine and a slide positioned adjacent to the machine. The cushion-creating machine includes a frame and cushion-creating assemblies which are mounted to the frame and which create cushioning products. The machine's frame includes an exit through which the cushioning products are discharged in a predetermined discharge direction. The slide includes a smooth sloped surface with a top portion positioned proximate to the machine's exit so that the discharged cushioning products will be deposited thereon. The smooth sloped surface has a pitch angle which is sufficient to insure that cushioning products placed on the top portion of the surface will slide in a predetermined slide direction.

The smooth sloped surface is oriented relative to the machine in such a manner that the slide direction is substantially perpendicular to the discharge direction. This geometric relationship allows the cushioning products to stack in a consecutive side-by-side arrangement and thereby present the pads in an orderly sequential fashion.

In the preferred embodiment, the slide includes a tray having a bottom wall which incorporates the smooth sloped surface. The bottom wall (and thus the transitional surface) has a length of approximately four feet and a width of approximately three feet. Consequently, the transitional zone can accommodate pads of substantial lengths. The height of the bottom edge of the tray is approximately thirty-six inches which positions the bottom (or front) edge of the tray at the waist level of the most packaging personnel. In this manner, a packaging person can easily retrieve the pads from the transitional zone (i.e., he/she does not have to bend over) thereby maximizing packaging efficiency.

The preferred support structure for the tray comprises a pair of front leg members attached to the front corners of the tray and a pair of back leg members attached to the back corners of the tray. When this type of support structure is used in combination with the preferred dimensions/pitch of the tray, the slide will occupy approximately 10½ square feet of floor space.

These and other features of the invention are fully described and particularly pointed out in the claims. The following descriptive annexed drawings set forth in detail one illustrative embodiment, this embodiment being indicative of but one of the various ways in which the principles of the invention may be employed.

DETAILED DESCRIPTION

Figure 1:
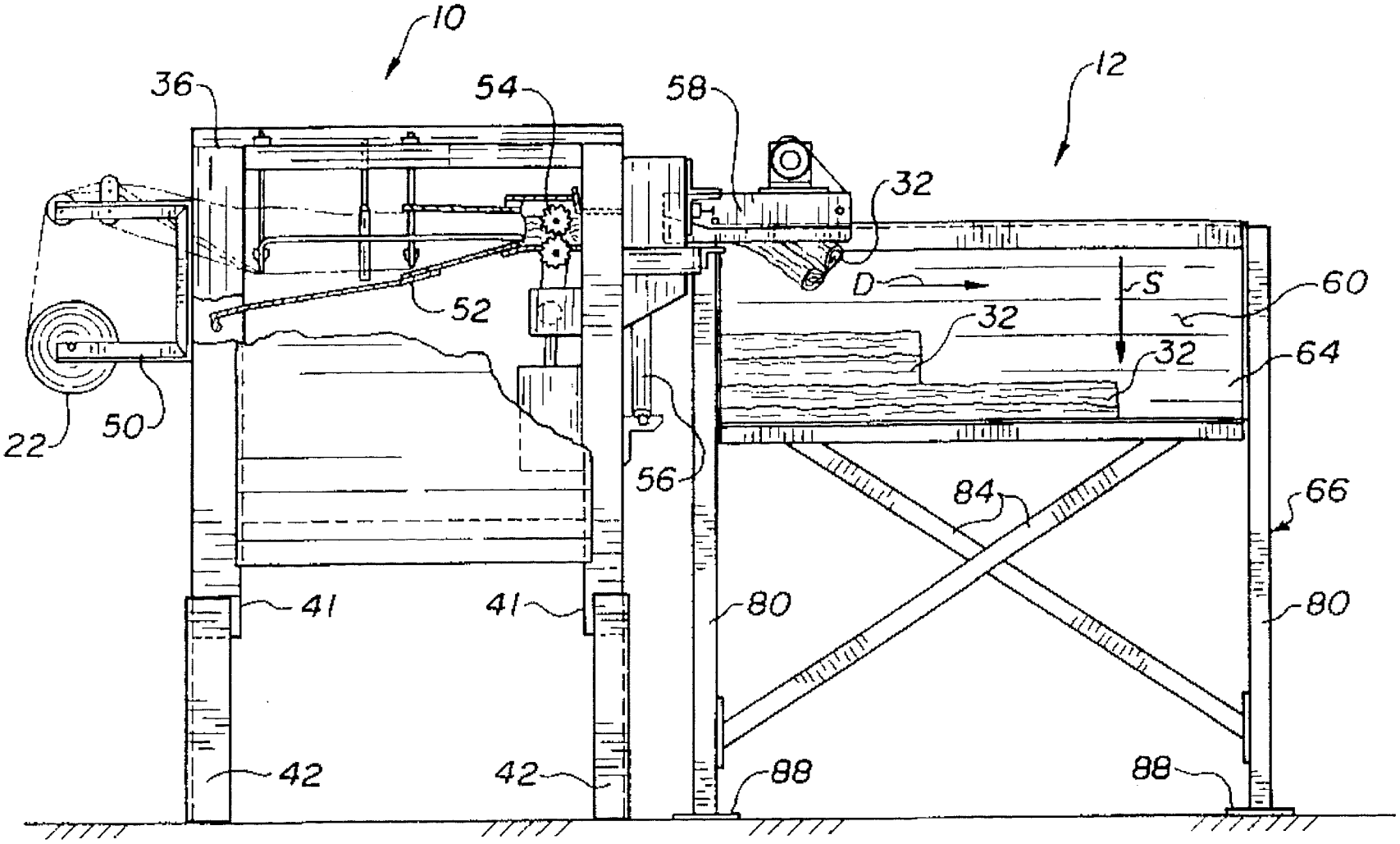
FIG. 1 is a front view of a packaging system according to the present invention, the system including a cushion-creating machine and a slide.

Referring now to the drawings in detail, a packaging system according to the present invention is shown. (See FIG. 1.) This packaging system includes a cushion-creating machine 10 and a slide 12 which is positioned adjacent to the machine 10. As is explained in more detail below, the slide 12 provides a transitional zone which can accommodate pads of substantial lengths, which presents the pads in an orderly sequential fashion, which occupies a minimal amount of space, and which maximizes packaging efficiency.

In the illustrated and preferred embodiment, the cushion-creating machine 10 is a cushioning conversion machine which is shown loaded with a roll of sheet-like stock material 22. The stock material 22 may consist of three superimposed webs of biodegradable, recyclable and reusable thirty-pound Kraft paper rolled onto a hollow cylindrical tube. The machine 10 converts this stock material 22 into cushioning products, or pads, 32 of a desired length. (See FIG. 1.)

The machine 10 comprise a frame 36 and cushion-creating assemblies which are mounted to the frame and which create the cushioning products 32. In the illustrated embodiment, the frame 36 is self-standing and includes four legs 41 (only two of which are visible in the illustrated orientation). "Stilts" 42 are provided so that the height of the machine 10 is appropriate for the transitional zone, or slide 12. Although not specifically numbered in the drawings, the machine's frame 36 includes an exit through which the cushioning products are discharged in a predetermined discharge direction D. (See FIG. 1.)

The cushion-creating assemblies (or, in the preferred embodiment, the cushioning conversion assemblies) include a stock supply assembly 50, a forming assembly 52, a gear assembly 54, and a cutting assembly 56, all of which are mounted on the frame 36. (See FIG. 1.) In the preferred and illustrated embodiment, the machine 10 further includes a pad-transferring assembly 58 which is also mounted to the frame extension 36. Such a pad-transferring assembly 58 is disclosed in a U.S. Patent Application to Simmons which is being filed concurrently herewith and which is entitled "Cushioning Conversion Machine Including a Pad-Transferring Assembly."

During operation of the machine 10, the stock supply assembly 50 supplies the stock material 22 to the forming assembly 52. The forming assembly 52 causes inward rolling of the lateral edges of the sheet-like stock material 22 to form a continuous strip having lateral pillow-like portions and a thin central band. The gear assembly 54 pulls the stock material 22 downstream through the machine and also coins the central band of the continuous strip to form a coined strip. As the coined strip travels downstream from the gear assembly 54, the cutting assembly 56 cuts the coined strip into pads 32 of a desired length. If the pad-transferring assembly 58 is used, it frictionally engages the leading portion of the coined strip prior to it being cut and then frictionally transfers the pad 32 (formed when the coined strip is cut) to the slide 12.

Figure 3:
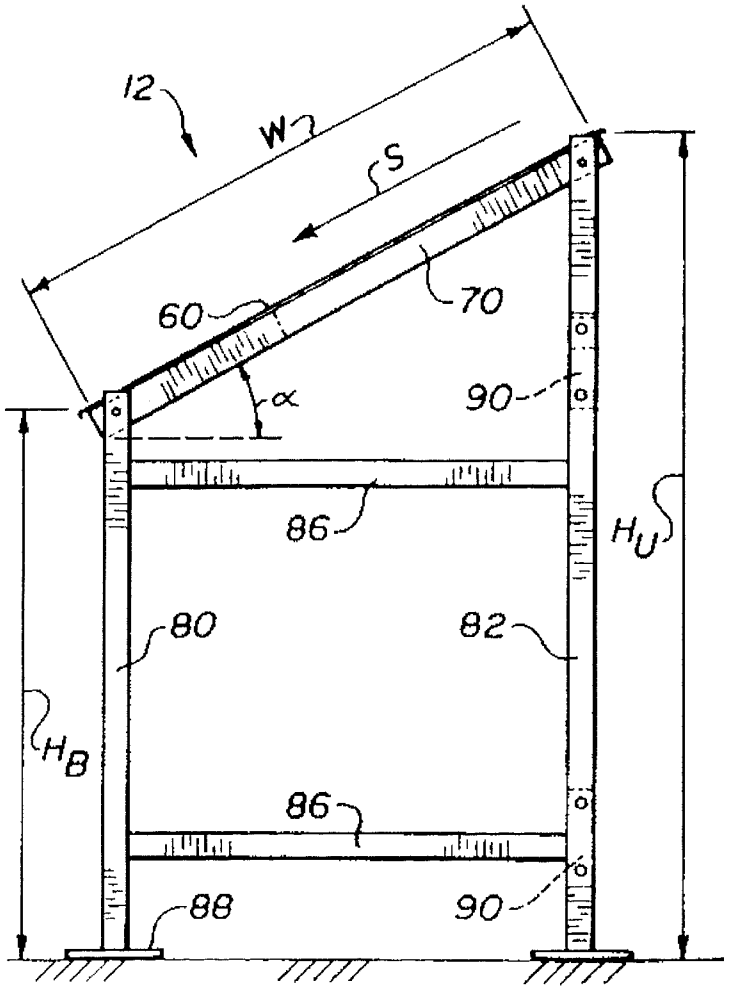
FIG. 3 is a side view of the slide.

The slide 12 includes a smooth sloped surface 60 which forms the transitional zone for the packaging system. The top portion of the surface 60 is positioned proximate to the machine's exit so that the discharged cushioning products 32 will be deposited thereon. (See FIG. 1.) The sloped surface 60 has a pitch angle $\alpha$ (see FIG. 3) which is sufficient to insure that cushioning products 32 deposited on its top portion will slide in a predetermined slide direction S (see FIG. 1). The pitch angle $\alpha$ is preferably between 25° and 35°, and, more preferably approximately 30°.

The smooth sloped surface 60 is oriented relative to the machine 10 in such a manner that the slide direction S is substantially perpendicular to the discharge direction D. (See FIG. 1.) Additionally, the plane of the smooth sloped surface 60 is substantially parallel to the discharge direction D. This geometric relationship allows the cushioning products 32 to stack in a consecutive side-by-side arrangement and thereby present the pads in an orderly sequential fashion.

In the preferred embodiment, the slide 12 includes a tray 64, which incorporates the smooth sloped surface 60, and a support structure 66, which supports the tray 64 (and thus the smooth sloped surface 60) in the proper orientation. The tray 64 includes a bottom wall 68 and a set of side walls 70 which surround the bottom wall 68 and which extend perpendicularly upward therefrom. The upper surface of the bottom wall 68 forms the smooth sloped surface 60.

The tray 64 is preferably of a one-piece fabrication and is preferably made of stainless steel. More preferably, the tray 64 is made of #2B finish stainless steel which is annealed, pickled, and bright cold rolled. This material selection is based on the desire to optimize the "smoothness" of the sloped surface 64 so that the pads 32 will slide frictionlessly down it. The tray 64 is preferably left unpainted to further this objective.

In the preferred form of the tray 64, the bottom wall 68 (and thus the transitional surface 60) has a length L of approximately four feet and a width W of approximately three feet. Thus, the transitional zone can accommodate pads of substantial lengths (i.e., approximately four feet). The side walls 70 form a two to three inch border around the bottom wall 68 (and thus the transitional surface 60) so that the stacked pads 32 will be retained therein. The upper edges of the side walls 70 are rolled, and their corners seams are welded, so that tray 64 will be free of any burs or projections which could cause interference during the packaging process.

As was indicated above, the support structure 66 supports the tray 64, and therefore the smooth sloped surface 60, in the proper orientation. In this proper orientation, the height $H_B$ of the bottom edge of the tray 64 is approximately thirty-six inches and the height $H_U$ of the tray's upper edge is approximately fifty-four inches. This positions the bottom (or front) edge of the tray 64 at the waist level of most packaging personnel. In this manner, a packaging person can easily retrieve the cushioning products 32 from the transitional zone (i.e., he/she does not have to bend over) thereby maximizing packaging efficiency.

The support structure 66 comprises a pair of front leg members 80, a pair of back leg members 82, a back brace member 84, and four side brace members 86. The particular design of the support structure 66 allows the slide 12 to occupy a minimal amount of space at the packaging site. Specifically, the slide 12 will occupy approximately 10½ square feet of floor space.

The support members 80, 82, 84, and 86 are all preferably made of steel and, more preferably, are all made of 11 gauge, 1½ inch square, tubular steel and painted to prevent rust. The front leg members 80 are attached (e.g., bolted) to the front corners of the tray 64 and the back leg members 82 are attached (e.g., bolted) to the back corners of the tray 64. In the preferred slide 12, the front leg members 80 are approximately 36½ inches long and the back leg members are approximately 52½ inches long. Additionally, the preferred leg members 80/82 include bottom mounting plates 88 which may be used for permanent installation of the slide 12 at the packaging site.

Figure 2:
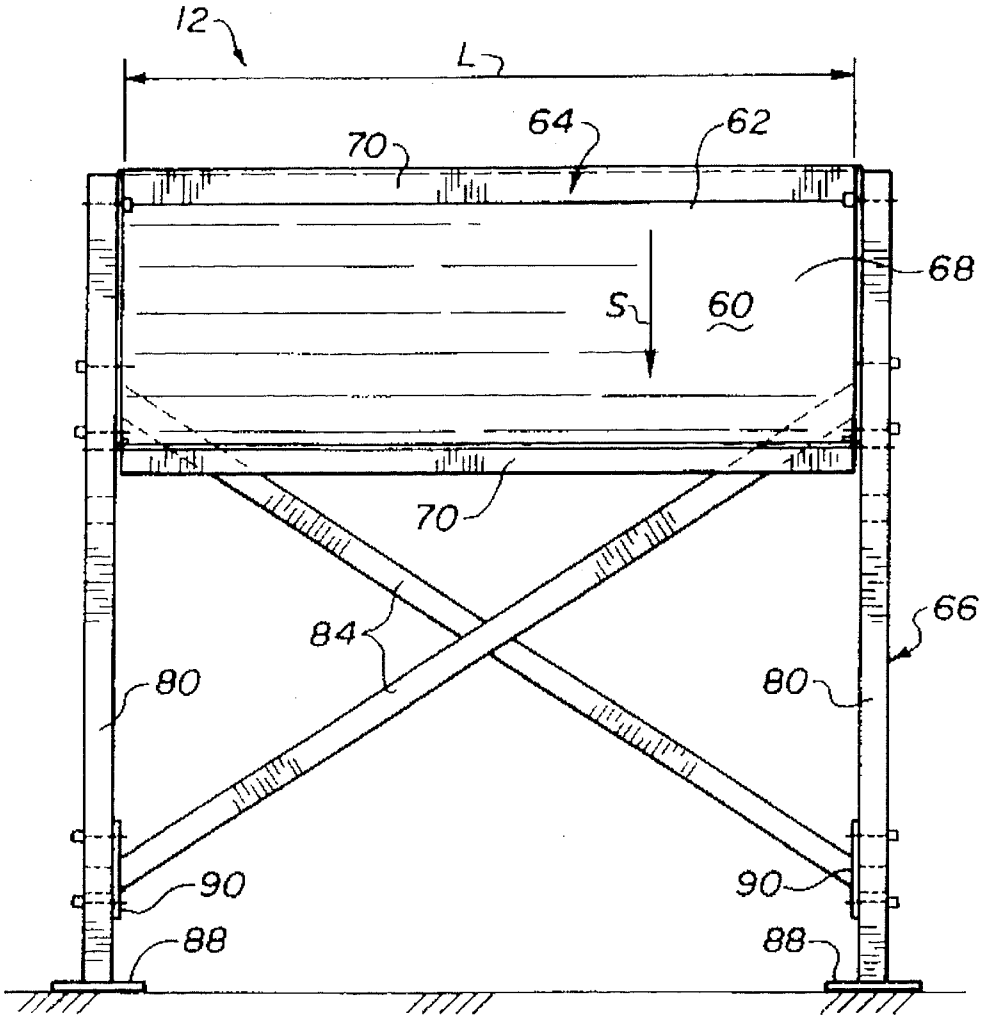
FIG. 2 is a front view of the slide.

The back brace member 84 is "criss-cross" component which extends between the back leg members 82. (See FIG. 2.) Preferably, a mounting plate 90 is attached (e.g., welded) to each of the four distal ends of the back brace member 84. In the assembly of the slide 12, the mounting plates 90 are attached (e.g., bolted) to the back leg members 82.

The side brace members 86 are linear components which extend between aligned front/back leg members 80/82. Specifically, in the preferred embodiment, two brace members 86 are horizontally arranged on each lateral set of front/back members 80/82. (See FIG. 3.) The ends of the side brace members 86 are preferably directly attached (e.g., welded) to the leg members 80/82.

The positioning of the support members 80, 82, 84 and 86 relative to each other, and the attachment (i.e., bolting v. welding) between these support members, allows the slide 12, when in an unassembled state, to be compactly shipped and/or stored. Particularly, the slide 12 disassembles into four substantially planar pieces: the tray 64, the back brace member 84, and the two sides of the support structure (i.e., a front leg member 80, a back leg member 82, and two side brace members 86 coupling them together).

Although the invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A cushion producing system comprising a cushion-creating machine and a slide positioned adjacent to the machine;

the cushion-creating machine including a frame and cushion-creating assemblies which are mounted to the frame and which create cushioning products;

the machine's frame including an exit through which the cushioning products are discharged in a predetermined discharge direction;

the slide including a smooth sloped surface with a top portion positioned proximate to the machine's exit so that the discharged cushioning products will be deposited thereon;

the smooth sloped surface having a pitch angle which is sufficient to insure that cushioning products placed on the top portion of the surface will slide in a predetermined slide direction; and the smooth sloped surface being oriented relative to the machine in such a manner that the horizontal component of the slide direction is substantially perpendicular to the horizontal component of the discharge direction wherein the slide includes a tray, which incorporates the smooth sloped surface, wherein the tray includes a bottom wall and a set of side walls which surround the bottom wall and which extend perpendicularly upward therefrom to provide a stop for the discharged cushion products and wherein an upper surface of the bottom wall forms the smooth sloped surface.

2. A cushion producing system as set forth in claim 1 wherein the tray is made of stainless steel.

3. A cushion producing system as set forth in claim 2 wherein the bottom wall, and thus the smooth sloped surface, has a length of approximately four feet and a width of approximately three feet.

4. A cushion producing system as set forth in claim 3 wherein the height of the bottom edge of the tray is approximately thirty-six inches above floor level.

5. A cushion producing system as set forth in claim 4 wherein the support structure comprises a pair of front leg members attached to the front corners of the tray and a pair of back leg members attached to the back corners of the tray.

6. A cushion producing system as set forth in claim 5 wherein the cushion-creating machine is a cushioning conversion machine which converts a sheet-like stock material into the cushioning products and which comprises:

a forming assembly which inwardly rolls the lateral edges of the sheet-like stock material to form a continuous strip having lateral pillow-like portions and a thin central band;

a stock supply assembly which supplies the sheet-like stock material to the forming assembly;

a gear assembly which pulls the stock material through the forming assembly and which coins the central band of the continuous strip to form a coined strip; and a cutting assembly which cuts the coined strip into pads of a desired length.

7. A cushion producing system as set forth in any of claims 1–6 wherein the pitch angle is between 25° and 35° relative to horizontal.

8. A cushion producing system as set forth in any of claims 1–6 wherein the pitch angle is approximately 30° relative to horizontal.

9. A cushion producing system comprising a cushion-creating machine and a slide positioned adjacent to the machine;

the cushion-creating machine including a frame and cushion-creating assemblies which are mounted to the frame and which create cushioning products;

the machine's frame including an exit through which the cushioning products are discharged in a predetermined discharge direction;

the slide including a smooth sloped surface with an upper portion positioned proximate to the machine's exit so that the discharged cushioning products will be deposited thereon;

the smooth sloped surface having a pitch angle which is sufficient to insure that cushioning products placed on the upper portion of the surface will slide in a predetermined slide direction;

the smooth sloped surface being oriented relative to the machine in such a manner that the horizontal component of the slide direction is substantially perpendicular to the horizontal component of the discharge direction; and the smooth sloped surface including a stop which causes the cushioning products to reach a rest position thereon with the cushioning products being stacked on the slide in a consecutive side-by-side arrangement and presented in an orderly sequential fashion.

* * * * *